US012329303B1

(12) United States Patent
McNaboe

(10) Patent No.: US 12,329,303 B1
(45) Date of Patent: Jun. 17, 2025

(54) COLLAPSIBLE STORAGE APPARATUS FOR SECURING PACKAGES

(71) Applicant: Brian James McNaboe, Seattle, WA (US)

(72) Inventor: Brian James McNaboe, Seattle, WA (US)

(73) Assignee: Brian J. McNaboe, Cambridge, MA (US)

( * ) Notice: Subject to any disclaimer, the term of this patent is extended or adjusted under 35 U.S.C. 154(b) by 72 days.

(21) Appl. No.: 17/930,456

(22) Filed: Sep. 8, 2022

(51) Int. Cl.

| | |
|---|---|
| ***A47G 29/20*** | (2006.01) |
| ***A47G 29/14*** | (2006.01) |
| ***A47G 29/30*** | (2006.01) |
| ***A47L 23/26*** | (2006.01) |

(52) U.S. Cl.
CPC ..... *A47G 29/20* (2013.01); *A47G 29/141* (2013.01); *A47G 29/30* (2013.01); *A47L 23/266* (2013.01); *A47G 2029/144* (2013.01)

(58) Field of Classification Search
CPC ..... A47G 29/20; A47G 29/141; A47G 29/30; A47G 2029/144; E05B 73/0005; B65D 29/00; A47L 23/26; A47L 23/263; A47L 23/266
See application file for complete search history.

(56) References Cited

U.S. PATENT DOCUMENTS

| | | | | | |
|---|---|---|---|---|---|
| 4,785,960 | A * | 11/1988 | Belisle | A47G 29/20 | 383/22 |
| 6,026,662 | A * | 2/2000 | Schlipper | A45C 3/001 | 70/59 |
| 6,871,184 | B1 * | 3/2005 | Liberman | G07F 7/00 | 705/15 |
| 10,076,204 | B1 * | 9/2018 | Sadeghi | A47G 29/141 | |
| 10,143,320 | B1 * | 12/2018 | Batts | A47G 29/16 | |
| 10,282,951 | B1 * | 5/2019 | Kulick | A47G 29/141 | |
| 10,786,104 | B1 * | 9/2020 | Pappas | A47L 23/266 | |
| 11,330,927 | B2 * | 5/2022 | Loures | E05B 67/383 | |
| 11,412,876 | B1 * | 8/2022 | Kadlub | A47G 29/20 | |
| 11,492,172 | B1 * | 11/2022 | Izquierdo | A47G 29/141 | |
| 11,877,681 | B2 * | 1/2024 | Willhoit | A47L 23/26 | |
| 11,889,937 | B2 * | 2/2024 | Meddah | G08B 3/1016 | |
| 11,944,217 | B1 * | 4/2024 | Sutherland | A47G 29/20 | |
| 12,133,604 | B2 * | 11/2024 | Courtney | A47G 29/141 | |
| 12,193,585 | B2 * | 1/2025 | de Jonge | A47G 29/20 | |
| 2012/0269461 | A1 * | 10/2012 | Proctor | G09F 23/00 | 383/42 |
| 2013/0077896 | A1 * | 3/2013 | Wiley | B65D 33/28 | 383/86.2 |
| 2015/0305538 | A1 * | 10/2015 | Sundaresan | A47G 29/141 | 70/64 |
| 2016/0051073 | A1 * | 2/2016 | Heinz | A47G 29/141 | 232/39 |

(Continued)

*Primary Examiner* — William L Miller

(57) ABSTRACT

A container for securing receipt of parcels or other items is disclosed. One embodiment includes a wire mesh collapsible container, closed at the bottom and sides and open at the top with a cinching mechanism that allows a parcel carrier to quickly and easily close the top, thus securing the package within. The container itself is secured to a fixed attachment point, and can only be opened by key once cinched by the carrier. Another embodiment includes a means for electronically notifying the parcel recipient once a package has been secured. Other embodiments are described and shown.

2 Claims, 5 Drawing Sheets

(56) References Cited

U.S. PATENT DOCUMENTS

| | | | | |
|---|---|---|---|---|
| 2017/0055751 | A1* | 3/2017 | Sundaresan | E05B 45/005 |
| 2018/0162612 | A1* | 6/2018 | Bojic | B65D 33/2516 |
| 2018/0177320 | A1* | 6/2018 | Chambers | E05B 65/52 |
| 2018/0202199 | A1* | 7/2018 | Critz | E05B 73/0005 |
| 2019/0038062 | A1* | 2/2019 | Sundaresan | A47G 29/124 |
| 2019/0104876 | A1* | 4/2019 | Loures | E05B 73/00 |
| 2019/0133362 | A1* | 5/2019 | Gilligan | A47G 29/20 |
| 2019/0223644 | A1* | 7/2019 | Hopp | A47G 29/20 |
| 2019/0231104 | A1* | 8/2019 | Dunkelberger | A44B 19/30 |
| 2019/0246828 | A1* | 8/2019 | Miller | A47G 29/124 |
| 2020/0015617 | A1* | 1/2020 | Izquierdo Gonzalez | G06Q 10/0832 |
| 2020/0060460 | A1* | 2/2020 | Farrar | A47G 29/141 |
| 2020/0331675 | A1* | 10/2020 | Jones | A47G 29/30 |
| 2020/0388095 | A1* | 12/2020 | Agbeyo | H04W 4/80 |
| 2020/0390313 | A1* | 12/2020 | Pappas | H04N 7/185 |
| 2021/0045563 | A1* | 2/2021 | Bartley-Clark | A47G 29/141 |
| 2021/0212493 | A1* | 7/2021 | Khatchikian | A47G 29/20 |
| 2022/0151420 | A1* | 5/2022 | Pappas | A47G 29/141 |
| 2022/0183491 | A1* | 6/2022 | Cooper | A47G 29/20 |
| 2022/0233010 | A1* | 7/2022 | Sundaresan | A47G 29/141 |
| 2023/0029102 | A1* | 1/2023 | de Jonge | A47G 29/141 |
| 2023/0124995 | A1* | 4/2023 | Yu | A47G 29/20 232/1 R |
| 2023/0157472 | A1* | 5/2023 | Barkman | A47G 29/20 232/1 R |
| 2023/0322456 | A1* | 10/2023 | Parks | B65D 55/14 220/210 |
| 2024/0197097 | A1* | 6/2024 | Gregory | A47G 29/141 |

* cited by examiner

COLLAPSIBLE STORAGE APPARATUS FOR SECURING PACKAGES

CROSS-REFERENCE TO RELATED APPLICATIONS

Not applicable

PRIOR ART

The following is a tabulation of some prior art that presently appears relevant:

U.S. Patents

| Patent Number | Kind Code | Issue Date | Patentee |
|---|---|---|---|
| 3824540 | A | 1974 Jul. 16 | Smith |
| 5347833 | A | 1994 Sep. 20 | Branscum |
| 5624071 | A | 1997 Apr. 29 | Sosan |
| 5774053 | A | 1998 Jun. 30 | Porter |
| 6155715 | A | 2000 Dec. 05 | Lake |
| 6300873 | B1 | 2001 Oct. 09 | Kucharczyk |
| 6323782 | B1 | 2001 Nov. 27 | Stephens |
| 6404337 | B1 | 2002 Jun. 11 | Till |
| 6426699 | B1 | 2002 Jul. 30 | Porter |
| 6756879 | B2 | 2004 Jun. 29 | Shuster |
| 6769611 | B2 | 2004 Aug. 03 | Miller |
| 6871184 | B1 | 2005 Mar. 22 | Liberman |
| 7815112 | B2 | 2010 Oct. 19 | Volpe |
| 8358199 | B2 | 2013 Jan. 22 | Nesling |
| 9364112 | B2 | 2016 Jun. 14 | Sundaresan |
| 9926108 | B2 | 2018 Mar. 27 | Wiley |
| 10143320 | B1 | 2018 Dec. 04 | Batts |
| 10653261 | B2 | 2020 May 19 | Loures |
| 10743694 | B2 | 2020 Aug. 18 | Raphael |
| 10786103 | B2 | 2020 Sep. 29 | Teoh |
| 11185181 | B2 | 2020 Jan. 13 | Khatchikian |
| 11197567 | B2 | 1931 Dec. 14 | Lemieux |
| 11311132 | B2 | 2022 Apr. 26 | Eivaz |
| 11330926 | B1 | 2022 May 17 | Root |
| 11344144 | B2 | 2022 May 31 | Curtis |
| 11399649 | B2 | 2022 Aug. 02 | Raphael |

U.S. Patent Application Publications

| Publication Nr. | Kind Code | Publ. Date | Applicant |
|---|---|---|---|
| 20120269461 | A1 | 2012 Oct. 22 | Proctor |

Foreign Patent Documents

| Foreign Doc. Nr. | Cntry Code | Kind Code | Publ. Date | Applicant |
|---|---|---|---|---|
| 2001015579 | GB | A1 | 2001 Mar. 8 | Towers-Clark |

Non-Patent Literature Documents

J. Edwards, A. Mckinnon, T. Cherrett, F. McLeod and L. Song, Green Logistics Report, Heriot-Watt University, "The impact of failed home deliveries on carbon emissions: Are collection/delivery points environmentally friendly alternatives?" (2009), available at www.greenlogistics.org/.

BACKGROUND OF THE INVENTION

With the increasing volume of home package delivery, fueled in large part by the advent of online shopping, there is a growing need for secure receipt of parcels in absentia. Commercial carriers such as FedEx, UPS, USPS and others perform most deliveries during common working hours (i.e., Monday through Friday, 9 am-5 pm), so it's no surprise that often times packages must be left unattended at the recipient's home while he or she is away at work.

Exacerbating the issue is the fact that carriers are sometimes unable or unwilling to leave a package unattended due to concerns of package theft. This leads to the dreaded door tag, or a written notice (often stuck to the recipient's front door) that informs the recipient that the carrier could not leave the package. In the best-case scenario, this delays receipt of the package by 1 day. Worse case, it may take several attempts to coordinate the pickup. Not only is this an inconvenience for the package recipient, it is also costly for the carrier to make multiple attempts at delivery. Particularly given their fee for delivery is most often fixed and does not increase with each attempt, thus each failed delivery erodes profits.

Lastly there is an environmental impact to failed deliveries. According to Edwards, failed package delivery, resulting most often from no one home to receive, can increase CO2 emissions by up to 75% per drop location per delivery attempt. The impact is even more severe when trips made by an individual in a car to pickup a package at a central depot are factored in, which by one calculation may produce the equivalent of 26 delivery attempts' worth of CO2.

There exist a number of approaches to addressing the problems associated with unattended package delivery. They generally fall into a few categories. The approach with the lowest initial investment is to effectively do nothing. That is to say, continue business as normal and accept the risk. On an individual level, delivery personnel may make a best effort attempt to hide packages from would be thieves (e.g., placing a box behind a front step planter), and some carriers allow recipients to provide delivery instructions that may help mitigate concerns (e.g., place package on back steps).

As already stated, the status quo, even with some amount of individual effort still leaves recipients exposed to casual theft. These crimes of opportunity, as they are sometimes called, can be committed by thieves without any sort of preparation or tools. Furthermore, the feeling of exposure to such a low barrier crime can cause anxiety-particularly on those occasions when a package is known to be sitting and waiting on the front steps, but the recipient is unable to return home immediately to secure it.

Another approach to addressing the issue of unattended package delivery is to not deliver the package to an unattended location at all. Instead, in this case, packages are sent to a location known to be secure. This takes on a couple forms, including automated parcel kiosks, such as Amazon Locker, USPS gopost, and DHL Packstation, and attended pack drops like a FedEx store, post office or other businesses contracted to receive and hold packages on behalf of recipients.

In a way, this is a non-solution to the problem of unattended home package delivery because the packages are not actually delivered to the home. These approaches require the recipient to travel to a package depot of some kind to pick up a package. This is an inconvenience, and largely defeats one of the primary motivations for shopping online-which is to avoid a trip to the store. Also, these options are often not viable for those living in less densely populated areas due to the lack of availability.

Yet another category of approach uses some means to provide package security at the recipient address. One well-known method involves deploying a lockable box, often made of metal, such as the commercially available Elephantrunk, and various other inventions similar to U.S. Pat. No. 5,774,053 to Porter (1998).

A problem with this approach is that it often requires installation of a receptacle. The receptacle itself may be heavy and/or expensive. These issues may render this approach impractical for some. Furthermore, the size of the receptacle, and thus the capacity, may be at odds with the aesthetic sensibilities of the resident(s). In other words, a large receptacle is necessary to receive large packages, but this may be an unwelcome sight at or near the front door or anywhere else for that matter.

There have been attempts in the art to mitigate the concerns related to receptacle size, as disclosed in U.S. patent application 20,120,269,461 by Proctor et al. (publ. 2012), U.S. Pat. No. 11,399,649 to Raphael (2022), U.S. Pat. No. 11,185,181 to Khatchikian (2020), U.S. Pat. No. 10,786,103 to Teoh (2020), U.S. Pat. No. 10,653,261 to Loures (2020), U.S. Pat. No. 6,871,184 to Liberman (2005), U.S. Pat. No. 6,426,699 to Porter (2002), and to a lesser extent U.S. Pat. No. 9,926,108 to Wiley (2018), U.S. Pat. No. 5,624,071 to Sosan (1997), and U.S. Pat. No. 8,358,199 to Nesling (2013). However, these inventions provide only a partial solution with limited container collapsibility and tidiness. For example, those cited and others, often include one or more rigid surfaces or otherwise have some structural impediment that prevents the container from achieving a fully flexible, and very low-volume profile when deployed and ready to receive packages.

Moreover, there has been little attention paid to ease of use of the secure container, particularly from the perspective of delivery personnel. As illustrated in the cited prior art, attention has instead been directed to cumbersome locking schemes of mainly solid doors, discrete flats and zippers. These schemes sometimes require a pre-exchange of keys or codes with the parcel carrier. In these ways, all secure doorstep parcel receptacles heretofore known suffer from unnecessarily bulky or untidy presentation, and overly difficult operation.

SUMMARY THE INVENTION

In accordance with one embodiment, a secure package apparatus comprises a flexible cut and tear resistant cable mesh container that is closed at the bottom with a wide opening at the top. The container, when not securing a package, lies nearly flat-having the appearance of a disk when viewed from above. The container is separately secured to a rail, post, door or other fixed attachment point near the place of parcel delivery using a cut resistant cable and pad lock or similar.

To operate, a package is placed on top of the container (disk), the container's sides are pulled up around and over the package and the top is securely cinched closed by means of a drawstring cinching cable. The cinching mechanism requires no key to close and can be operated very quickly and easily by pulling the end of the cinching cable while holding the container in place (like starting a lawn mower). The recipient uses a key to release the top cinch, widen the opening and then remove the package. Once the package is removed, the container collapses naturally into its ready-to-receive package state.

Accordingly several advantages of one ore more aspects are as follows: a low-profile appearance, extremely compact when collapsed, lightweight, relatively inexpensive construction, easy to deploy and operate, with security similar to a bike cable lock or better when a plurality of securing features are incorporated. Other advantages of one or more aspects will be understood by persons skilled in the art in view of the following detailed description and the accompanying drawings.

DRAWINGS REFERENCE NUMERALS

Figure 1A:
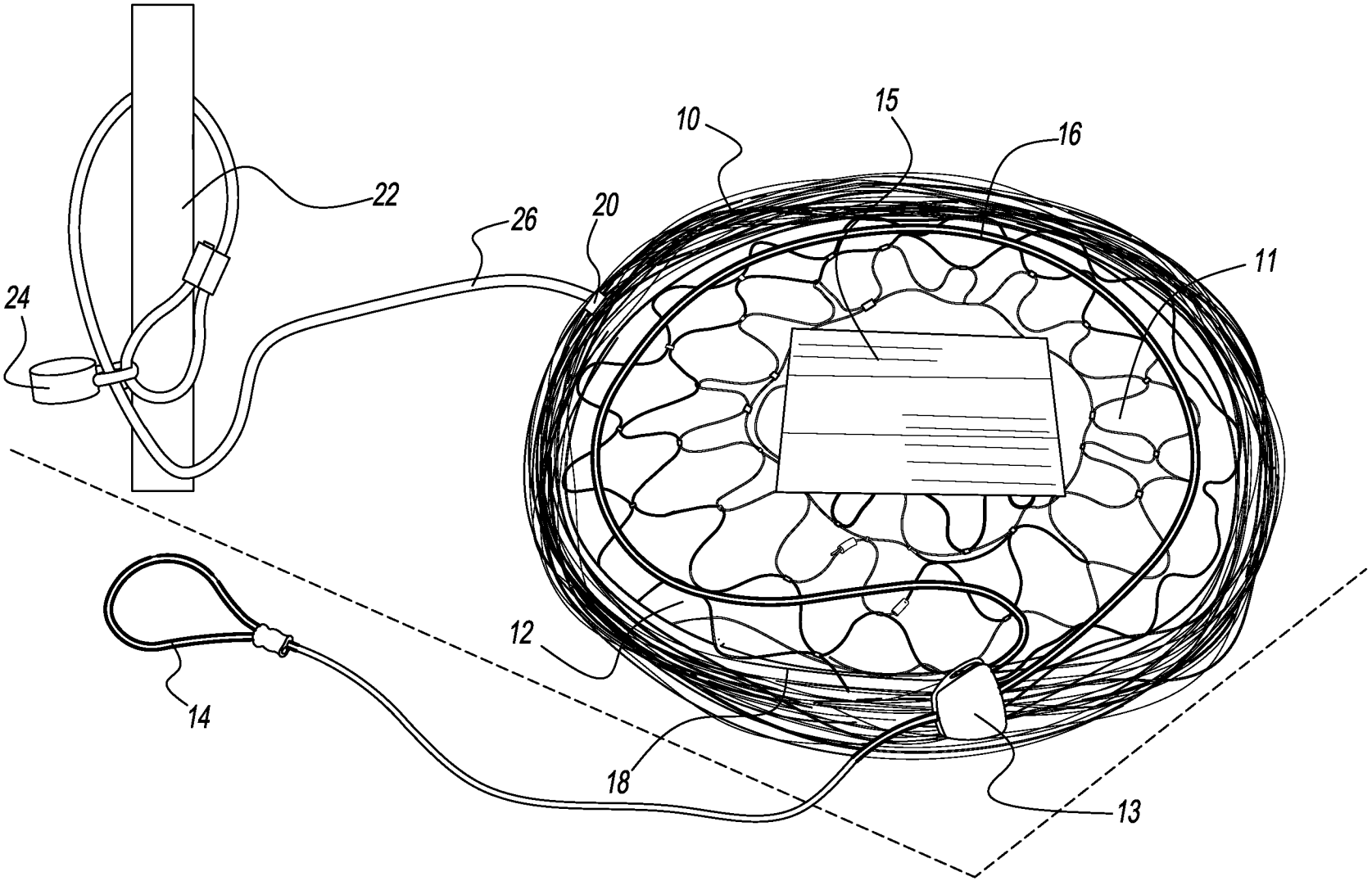
FIG. 1A is a perspective view of the collapsed container assembly according to one embodiment of the invention.

10 collapsible container tube
11 container opening
12 container base
13 cinching lock mechanism
14 pull handle
15 carrier instructions placard
16 cinching cable
18 base ring
20 securing cable container attachment
22 fixed attachment point
24 securing cable lock
26 securing cable
28 package
30 cable mesh flex joint
32 flex joint ferrule
34 ferrule pin connection
36 mesh cable
37 integrated doormat

DETAILED DESCRIPTION OF THE INVENTION

Figure 1B:
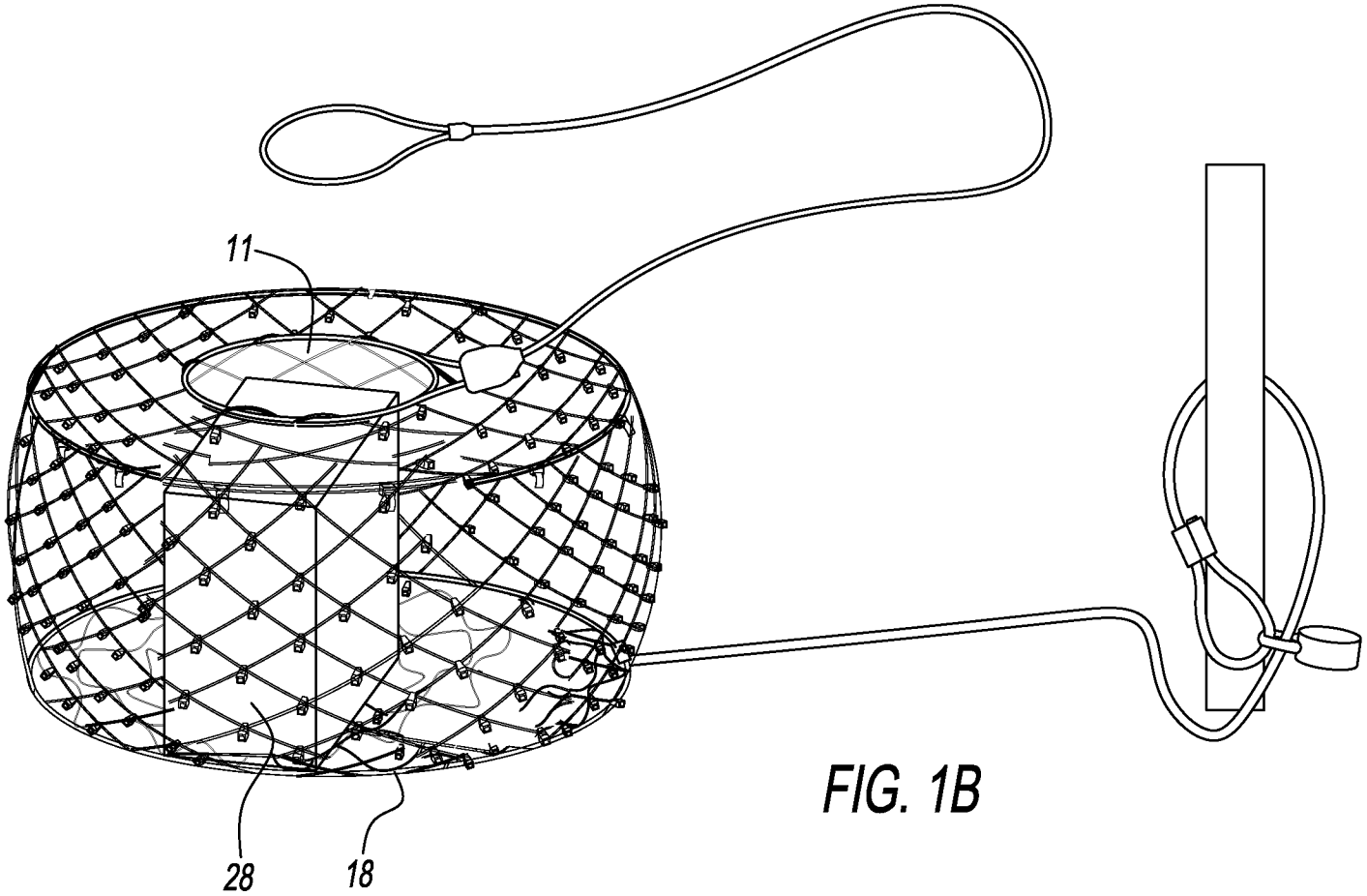
FIG. 1B is a perspective view of the same container assembly in FIG. 1A in an expanded state with a representative package securely contained inside.

In accordance with one embodiment, a secure package container comprises a flexible cut and tear resistant cable mesh tube 10, permanently closed at the bottom 12 with a cinching drawstring closure at the top. This container assembly is depicted in FIG. 1A (no package present) and FIG. 1B (package securely contained).

Figure 2A:
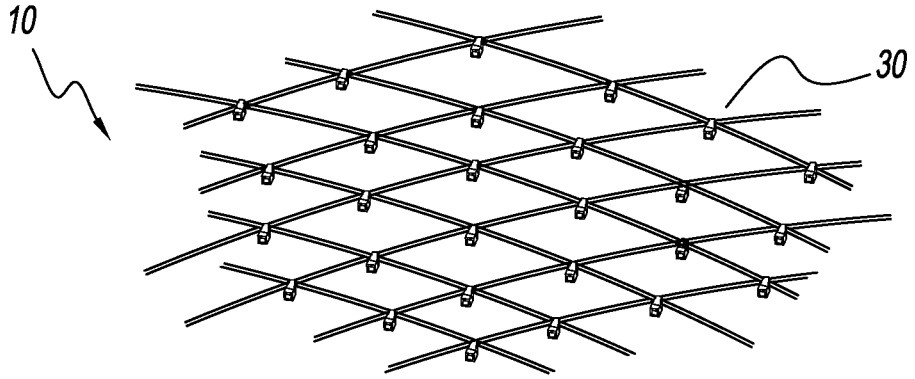
FIG. 2A is a detailed view of the cable mesh container 10 in a partially collapsed state, similar to how it would appear as part of the full assembly depicted in FIG. 1A.

The collapsible container tube 10 is composed of braided steel cable that is strategically woven into an articulating lattice structure. FIG. 2A depicts the cable mesh container tube 10 in a partially collapsed state, similar to the state the mesh would assume when the container is empty and ready to receive a package (as in FIG. 1A). As the container tube is pulled up around the package 28, the mesh articulates at the cable mesh flex joints 30 to allow the mesh to expand as depicted in FIG. 2*b*.

Figure 2B:
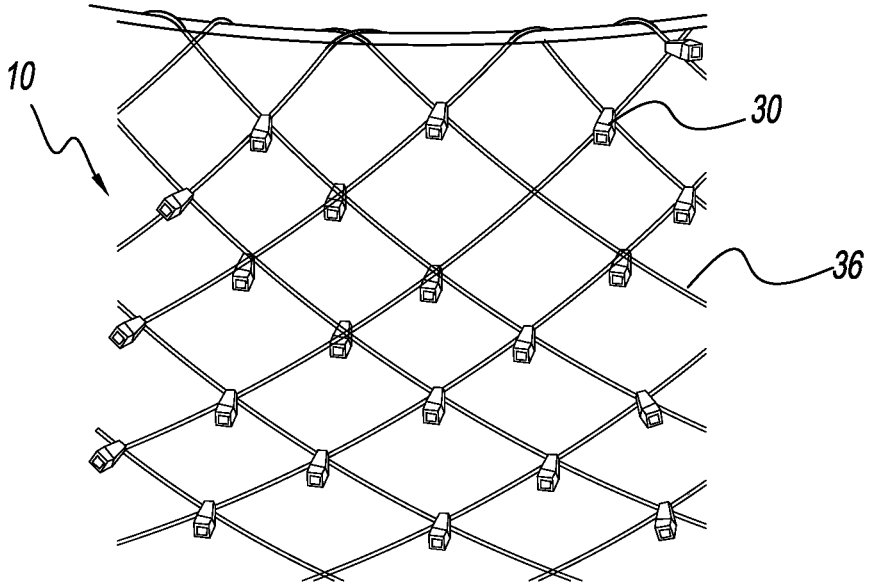
FIG. 2B is a detailed view of the cable mesh container 10 in an expanded state, similar to how it would appear as part of the full assembly depicted in FIG. 1B.
Figure 3:
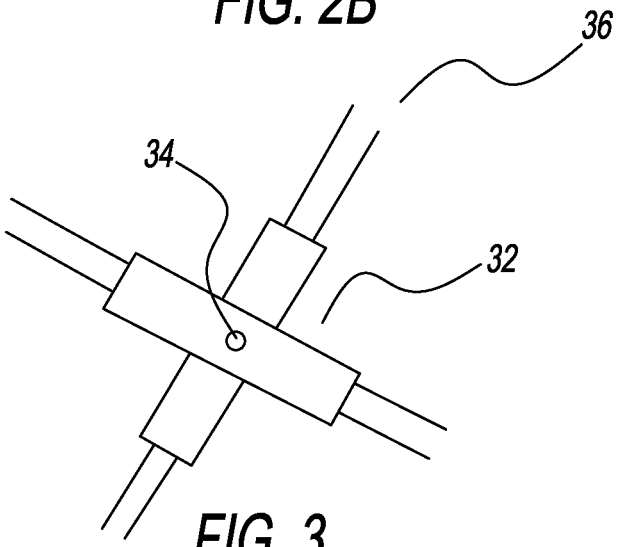
FIG. 3 is a detailed view of a cable mesh flex joint
Figure 4A:
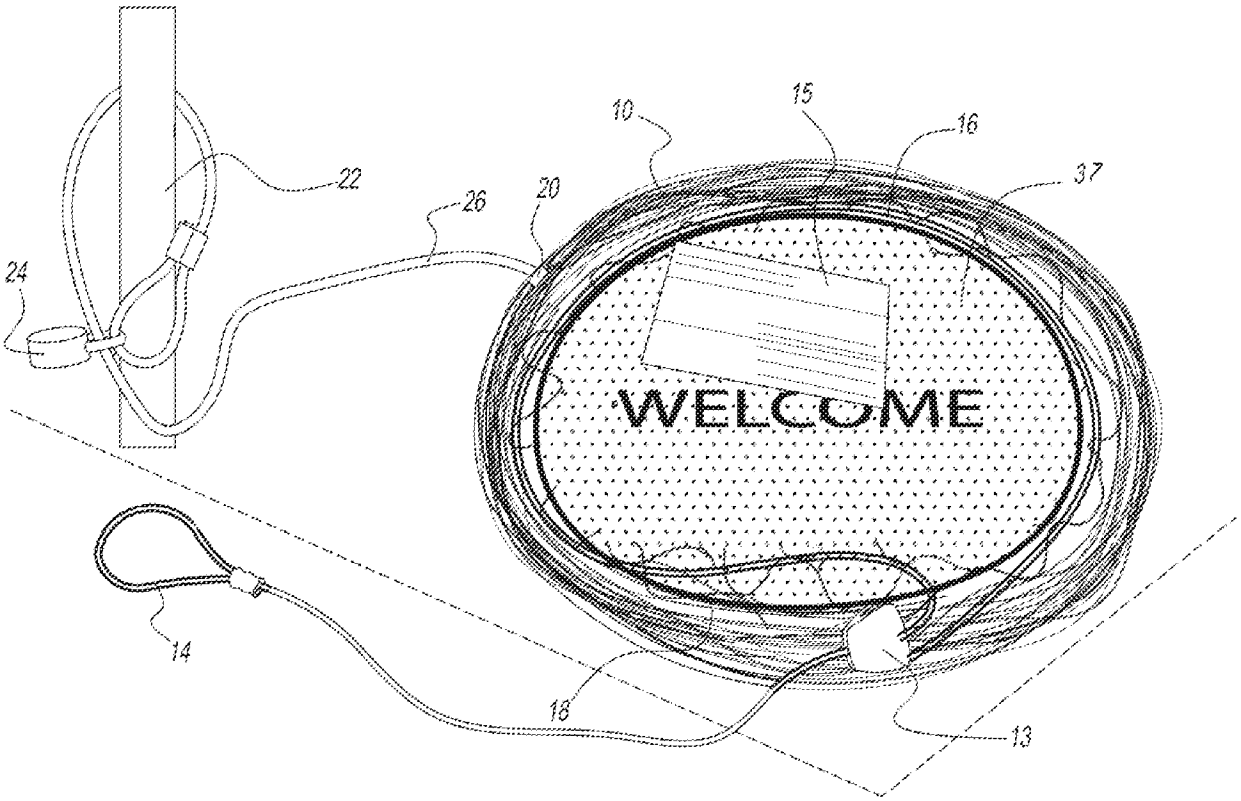
FIG. 4A is a perspective view of the collapsed container assembly integrated with a doormat, according to one embodiment of the invention.
Figure 4B:
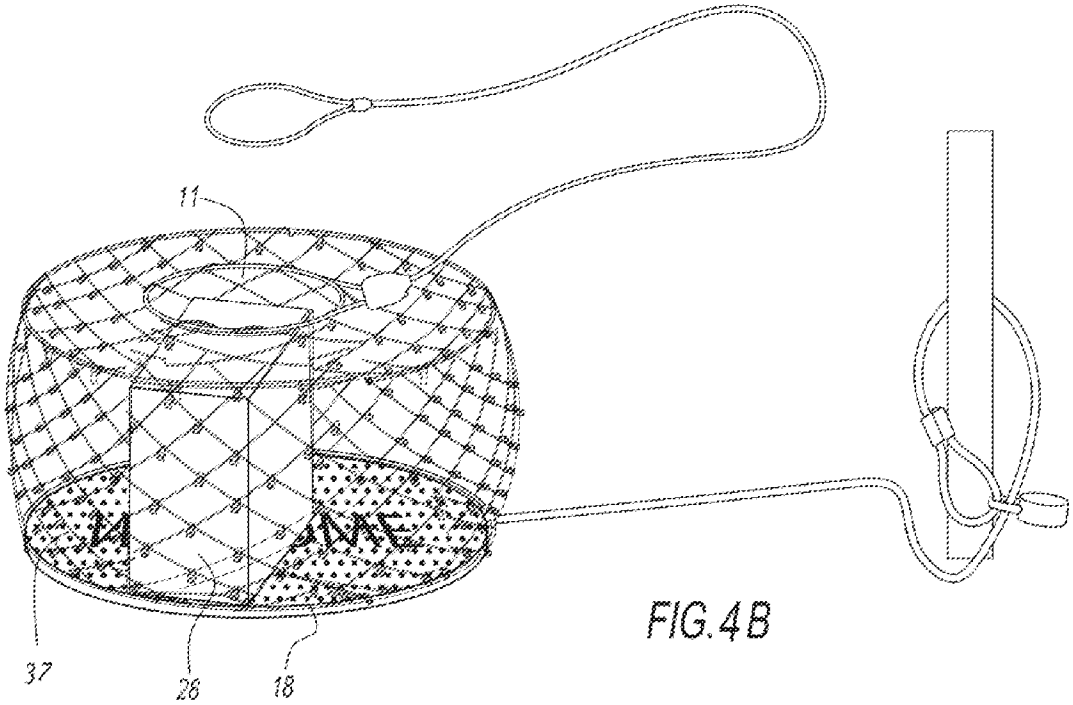
FIG. 4B is a perspective view of the same container assembly in FIG. 4A in an expanded state with a representative package securely contained inside.

The flex joints 30 articulate in plane with the cable mesh allowing the lattice structure to move freely from a collapsed (FIG. 2A) to expanded state (FIG. 2B). In FIG. 3 is depicted a detailed view of a flex joint 30, of which there are many within the container tube 10. Furthermore, the container tube itself 10 is composed of a meshwork of cut and tear resistant cables 36. These cables are clamped securely within cable ferrules 32 which are in turn attached in pairs through a pin connection 34 to form the lattice structure depicted in FIG. 2A and b. The flex joints 30 are arrange in such a way as to create a maximum gap between joints generally smaller than a typical package and roughly the size of two fists or less (so as to limit access).

The base of the container 12 is composed of a similar cut and tear resistant material as the tube 10, but does not require the same type of articulation so it may optionally use a simplified, or otherwise more suitable, cable weave. At or near the connection point of the container tube 10 and the container base 12 is a base ring 18 that is composed of a larger diameter cable than that used in the wire mesh container tube 10, or another semi-rigid flexible material. This component gives the container assembly a circular shape, which helps it maintain a ready to receive state and improves overall tidiness of the apparatus.

At the top of the container 10 is a cinching lock 13 that controls the movement of the cinching cable 16 and thus the size of the container opening 11. The outside end of the cinching cable 16 is terminated with a pull handle 14 to facilitate cinching. The maximum diameter of the container opening 11 is slightly larger than the base ring 18 diameter to make it easier to pull the cinching cable 16 up and over packages 28

Attached to the base ring 18 is a securing cable 26. The point of attachment 20 is achieved by looping the securing cable 26 around the base ring 18 then permanently clamping it back on itself. The other end of the securing cable 26 can be looped around any fixed structure 22, such as a handrail, gate, or door handle, then locked in place using a padlock 24 or other cable locking means commonly known. In this way, the secure container assembly can be easily deployed and removed from service in a matter of a few minutes by a single layperson.

In order to secure a package 28, the package is placed on the base disk 12 within the bounds of the base ring 18, then the cinching cable 16 is lifted over the top of the package 28, effectively expanding the container tube 10 and then the container is cinched closed. The cinching closure on the top of the container 10, comprised of 13 14 16, is operated by holding the cinching lock 13 and pulling on the cinching cable handle 14 so as to close the container opening 11 by shortening the amount of cinching cable 16 on the container side of the lock 13.

To open the secure container and remove the package 28, the cinching lock mechanism 13 must be unlocked with a key, combination or through another authenticated method, to allow the cinching cable 16 to be released. Once released, the cinching cable 16 can move freely allowing a user to effectively widen the container opening 11 and remove the package.

In this way, a package can very easily be secured within the container without the need for additional steps, such as opening or closing a door, or unlocking any portion of the apparatus. No key or code is required by a parcel carrier or anyone wishing to secure a package. Simply place the package insider the container, pull up the wire mesh tube and cinch.

In another embodiment, the cinching lock 13 is equipped with a battery, sensors and wireless communication componentry. An optical sensor, similar in function to that found in a modern computer mouse, is available to monitor the movement of the securing cable 26 through the cinching lock 13. Compact gyroscopic sensors, similar to those found in modern smartphones and familiar to one skilled in the art, can detect movement of the apparatus. Wireless communication componentry, again similar to that found in modern smartphones and familiar to one skilled in the art, is used to communicate over an available Wi-Fi network with a paired Internet based service.

Equipped as such, any tightening or loosening of the cinching cable 16, or any movement or jostling of the cinching lock 13 or assembly in general, is detected as a change in status (known as an event). Each event is communicated to the paired Internet based service over an available Wi-Fi connection. From there the paired Internet service uses software-based logic to determine if, when and how to notify registered subscribers of said event. Subscribers can include, but are not limited to, parcel recipients, parcel carriers, and other computer systems. Notifications can be sent from the paired Internet based service via email, SMS/MMS text message or some other form of communication. Likewise, instructions can be sent from the Internet based service to the apparatus to trigger certain behaviors. For example, remotely unlocking the cinching cable 16. Keylessly unlocking the cinching cable can also be accomplished without the need for communication with an Internet based service, for example by storing authorization codes within durable memory on the lock mechanism 13 and then passing an authorized code to the lock mechanism from a device capable of communicating with the lock mechanism wirelessly.

As a variation of the alternate embodiment previously described, a compact digital camera sensor, similar to one found in a modern smartphone is incorporated into the lock mechanism 13, and used to detect a barcode or other computer recognizable image. This image acts as an authentication mechanism, and with the help of the Internet based service, can trigger authorized behavior such as keyless unlocking of the cinching cable 16.

In yet another embodiment, the container tube 10, base 12, cinching cable 16, securing cable 26 and any other component that can be cut or torn to create a breach of container security, incorporate an alarm similar to that disclosed in U.S. Pat. No. 3,824,540 to Smith (1974) and housed within the lock mechanism 13, whereby cutting or tearing the securing material, or otherwise tampering with the storage apparatus triggers a loud audible alarm as a deterrent to theft. In the case of the present embodiment, a status change event is also detected leading to a notification message being sent as previously described.

From the description above, a number of advantages of some embodiments of the storage apparatus become evident:

a. Compact and tidy presentation is achieved through use of strong but flexible materials and the fully collapsible/expandable nature of the container.

b. Ease of use, particularly for parcel carriers, is apparent given the simple steps necessary (e.g., place package, lift and cinch). It has been shown that no pre-approval or arrangement with parcel carriers is needed.

c. The storage apparatus is inexpensive to produce due to its relatively low cost of materials and straightforward assembly (e.g., as compared to solid sheet metal containers).

d. No permanent or cumbersome installation is necessary. In one scenario, a user can lay the storage apparatus next to a front door, lock the securing cable and start receiving packages.

e. Eases anxiety by deterring package theft and providing real-time notifications of delivery and device status.

While the above description contains many specificities, these should not be construed as limitations on the scope, but rather as exemplifications of a number of embodiments. Many other variations are possible. For example the wire mesh container 10 can be constructed of any suitably flexible and durable material, in any shape, with fixed joints or articulating joints similar to 30, so long as it resists cutting and tearing and can achieve a low profile when not in use. The container 10 can employ a weather resistant cover to further protect a contained package 28 from rain or other environmental damage. When said cover is also opaque, this can obscure the contents and add a level of privacy. Furthermore, the cinching lock mechanism 13 can provide the ability to more easily tighten the cinching cable 16, by use of gearing, pulleys or other means, such that pulling the handle 14 results in a relatively greater reduction of the circumference of the container opening 11 than the distance the handled 14 is pulled. Further still, the container closure mechanism can use an approach other than an cinching drawstring. For example, a clamshell type hinge mechanism can be used to quickly and easily fold closed the container opening 11 with a lock at the hinge or clasp that prevents unauthorized opening. Various means of apparatus storage are also possible, including but not limited to, tucking into a small storage bin or hanging it on a hook near the place of delivery when not in use.

Additionally, the container base 12 can be integrated with or concealed within a doormat 37 where the doormat itself serves as the base of the container.

On the issue of wireless communication, a protocol other than Wi-Fi can be employed such as Bluetooth, Bluetooth low energy (Bluetooth LE) or any other available means to wirelessly communicate with the apparatus.

Accordingly, the scope should be determined not by the embodiments illustrated, but by the appended claims and their legal equivalents.

The invention claimed is:

1. An apparatus for securing delivery and authorized retrieval of packages, comprising a vertically collapsible container having a closed bottom and sides and a top opening within which at least one package can be inserted, means for securely closing said opening, means for securing said container to a fixed attachment point, whereby said container is collapsed when not containing said at least one package to achieve a vertically compact appearance, and conversely expanded as needed to accommodate said at least one package, with said means for securing said container effectively preventing unauthorized removal of said container and said at least one package once said at least one package is inserted in said container and said container is closed, wherein said container is constructed at least in part of a directionally biased wire mesh configuration, whereby said container when collapsed lays nearly flat when not containing said at least one package, and wherein at least one of the intersections of said wire mesh comprises an articulating flex joint pin connection.

2. A method for securing delivery and authorized retrieval of packages, comprising providing an expandable container having a closed bottom and sides and a top opening within which at least one package can be inserted, a means for securing said container to a substantially immovable attachment point, placing said at least one package inside said opening, expanding said container to fully contain said at least one package, a means for securely closing said opening that incorporates a drawstring cinching cable, providing a means to release and open said opening by those authorized, whereby said at least one package is effectively trapped within said container and can only be retrieved via authorized use of said means to release and open said opening, wherein said container incorporates a doormat, whereby the at least one package is placed on the doormat, and the container is expanded vertically around the at least one package, with the doormat defining the closed bottom of the container.

* * * * *